US005947373A

United States Patent [19]

Saito et al.

[11] Patent Number: 5,947,373

[45] Date of Patent: Sep. 7, 1999

[54] REFRIGERANT CIRCUIT WITH FLUID HEATED REFRIGERANT

[75] Inventors: Junichi Saito, Ashikaga; Ryuji Miya, Oizumi-machi, both of Japan

[73] Assignee: Sanyo Electric Co., Ltd., Osaka, Japan

[21] Appl. No.: 08/794,427

[22] Filed: Feb. 5, 1997

[30] Foreign Application Priority Data

| | | | |
|---|---|---|---|
| Feb. 9, 1996 | [JP] | Japan | 8-23831 |
| Feb. 22, 1996 | [JP] | Japan | 8-35026 |
| Feb. 26, 1996 | [JP] | Japan | 8-38538 |

[51] Int. Cl.[6] ..... G05D 23/00

[52] U.S. Cl. ..... 237/2 B; 165/240

[58] Field of Search ..... 237/2 B; 165/240, 165/242

[56] References Cited

U.S. PATENT DOCUMENTS

| | | | |
|---|---|---|---|
| 4,516,408 | 5/1985 | Chiba | 62/238.7 |
| 4,802,529 | 2/1989 | Sumitani et al. | 165/29 |
| 4,905,894 | 3/1990 | Noguchi | 237/2 B |
| 5,044,425 | 9/1991 | Tatsumi et al. | 165/29 |
| 5,174,365 | 12/1992 | Noguchi et al. | 165/29 |
| 5,305,614 | 4/1994 | Gilles | 62/238.7 |
| 5,320,166 | 6/1994 | Swenson | 165/18 |

FOREIGN PATENT DOCUMENTS 6-33296 8/1994 Japan .

*Primary Examiner*—Henry Bennett
*Assistant Examiner*—Derek S. Boles
*Attorney, Agent, or Firm*—Darby&Darby

[57] ABSTRACT

A heat exchange unit having a first heat exchanger 23 serving as an air heat source, a second heat exchanger 26 which is supplied with fluid such as hot water or the like to heat refrigerant, and a fluid amount adjusting mechanism 30,33 for adjusting the amount of the fluid to be supplied to the second heat exchanger, an air conditioner having the heat exchanger unit, and an air conditioning system having the air conditioner. The second heat exchanger 26 is disposed in a surplus space which is formed by the first heat exchanger 23 and an air blower 41 for promoting heat exchange between the air and the refrigerant flowing in the first heat exchanger 23. The upper portion of the case of the second heat exchanger 26 is provided with a fluid outlet port 100 and a refrigerant outlet port 101 while the lower portion of the case of the second heat exchanger 26 is provided with a fluid inlet port 103 and a refrigerant inlet port 104.

11 Claims, 14 Drawing Sheets

FIG. 2

| OPERATING HORSEPOWER | | | 1 | 2 | 3 | 4 | 5 | 6 | 7 | 8 | 9 | 10 |
|---|---|---|---|---|---|---|---|---|---|---|---|---|
| COMPRESSING APPARATUS 8 | 4-HORSEPOWER COMPRESSOR (9b) | SAVE OPERATION (VALVE 13 OPENED) | ON | ON | OFF | OFF | OFF | OFF | ON | ON | OFF | ON |
| | | FULL-POWER OPERATION (VALVE 11 OPENED) | OFF | OFF | ON | ON | OFF | OFF | OFF | OFF | ON | ON |
| | 6-HORSEPOWER COMPRESSOR | | OFF | OFF | OFF | OFF | ON | ON | ON | ON | ON | ON |
| OPEN/CLOSE OF BYPASS VALVE 18 | | | ON | OFF | ON | OFF | ON | OFF | ON | OFF | OFF | OFF |

FIG. 3

OPEN/CLOSE STATE OF OPEN/CLOSE VALVE

| NUMBER OF OPERATING INDOOR UNITS | 1 TO N | ABOVE N |
|---|---|---|
| BELOW 55 DEGREES (FLOW AMOUNT) | CLOSED (4 LITER/M) | OPENED (11.5 LITER/M) |
| ABOVE 55 DEGREES (FLOW AMOUNT) | CLOSED (4 LITER/M) | OPENED (4 LITER/M) |

FIG.12

| | MODE | POWER (EXPERIMENTAL RESULT) |
|---|---|---|
| PARALLEL FLOW/ PRESENT INVENTION | HEATED FLUID OUTLET PORT (100)<br>REFRIGERANT OUTLET PORT (101)<br>HEATED FLUID INLET PORT (103)<br>REFRIGERANT INLET PORT (104) | 17800Kcal/h (104.7%) |
| COUNTER FLOW/ COMPARATIVE EXAMPLE | HEATED FLUID OUTLET PORT<br>REFRIGERANT OUTLET PORT<br>HEATED FLUID INLET PORT<br>REFRIGERANT INLET PORT | 17100Kcal/h (100%) |

REFRIGERANT CIRCUIT WITH FLUID HEATED REFRIGERANT

BACKGROUND OF THE INVENTION

1. Field of the Invention

The present invention relates to a heat exchange unit having a first heat exchanger serving as an air heat source, and a second heat exchanger for heating refrigerant with heated fluid, an air conditioner having the heat exchange unit, and an air conditioning system having the air conditioner.

2. Description of Related Art

In such a cold region as Hokkaido, a so-called "heat pump type air conditioner" using an air heat source in heating operation does not provide a sufficient heating effect in some cases. In order to take a countermeasure to these cases, there has been proposed a heat pump type air conditioner which is equipped with an apparatus for heating refrigerant with a boiler or the like to use the heated refrigerant as a heat source (as disclosed in Japanese Utility Model Publication No. Hei-6-33296).

In such an air conditioner, when refrigerant is directly heated by a boiler, the combustion power of the boiler must be adjusted in accordance with an air conditioning load, and thus a boiler having a capability of adjusting the combustion power or a control equipment for controlling the combustion power of a boiler must be installed into the heat pump type air conditioner. Accordingly, cost-up is unavoidable in this type air conditioner. Furthermore, in this type air conditioner , a compressor, an air blower (fan), a heat exchanger, etc. are accommodated in a housing of a heat exchange unit, and the housing is designed to have an exclusively-used space (chamber) for accommodating a heat exchanger which is used to perform heat exchange between the refrigerant and the boiler. Therefore, the housing of the heat exchange unit must be designed in large size.

SUMMARY OF THE INVENTION

Therefore, a first object of the present invention is to provide an air conditioner in which a second heat exchanger for heating refrigerant can be installed with suppressing cost-up as much as possible.

A second object of the present invention is to provide an air conditioner in which large-size design is unnecessary to a housing in which a compressor, an air blower, etc. are accommodated even when a second heat exchanger for heating refrigerant is installed into the housing.

In order to attain the above objects, according to a first aspect of the present invention, an air conditioner includes a first heat exchanger serving as an air heat source for performing heat exchange between refrigerant and air, a second heat exchanger for performing heat exchange between the refrigerant and heated fluid such as hot water or the like (e.g., the second heat exchanger is supplied with both the heated fluid and the refrigerant to heat the refrigerant), and fluid amount adjusting means (controller) for adjusting the amount of the heated fluid to be supplied to the second heat exchanger.

According to the first aspect of the present invention, a sufficient effect can be achieved by providing only the second heat exchanger for heating the refrigerant and the controller serving as the fluid amount adjusting means. Therefore, a time required for design can be shortened and increase in number of parts can be suppressed.

In the air conditioner as described above, the fluid amount adjusting means adjusts the amount of the fluid in accordance with an air conditioning load.

In the air conditioner as described above, the fluid amount adjusting means comprises plural control valves which are disposed in parallel to one another in an inlet pipe for supplying the fluid into the second heat-exchanger and adapted to adjust the amount of the fluid to be supplied to the second heat exchanger.

According to a second aspect of the present invention, a air conditioning system comprises an outdoor unit having a first heat exchanger serving as an air heat source for performing heat exchange between refrigerant and air, and a second heat exchanger which is supplied with the fluid to heat the refrigerant, plural indoor units connected to the outdoor unit, a fluid heating source which is connected the second heat exchanger through a circulating pump and adapted to heat the fluid, fluid amount adjusting means for adjusting the amount of the heated fluid to be supplied to the second heat exchanger.

According to a third aspect of the present invention, an air conditioning system comprises a compressing apparatus, an indoor heat exchanger, an expansion device and a heat exchanger to which fluid such as hot water or the like is supplied to heat refrigerant, is characterized in that the compressing apparatus comprises a power-variable type compressor, and the amount of the fluid to be supplied to the second heat exchanger is made variable, and that the power of the compressing apparatus and the amount of the fluid to be supplied to the second heat exchanger are adjusted in accordance with an air conditioning load of a room.

According to a fourth aspect of the present invention, a heat exchange unit includes a first heat exchanger serving as an air heat source for performing heat exchange between refrigerant and air, an air blower for promoting heat exchange between the air and the refrigerant flowing into the first heat exchanger, a second heat exchanger to which the refrigerant is supplied to heat the refrigerant, and a housing for accommodating the first heat exchanger, the air blower and the second heat exchanger, wherein the second heat exchanger is disposed in a surplus space which is formed by the first heat exchanger and the air blower.

In the heat exchange unit as described above, the first heat exchanger is disposed around the air blower so that at least a part of the surrounding of the air blower is opened, and the second heat exchanger is disposed at the open portion of the first heat exchanger.

In the heat exchange unit as described above, the first heat exchanger is designed to have a substantially U-shaped section, the air blower is disposed substantially at the center of the first heat exchanger, the second heat exchanger is disposed at the open portion of the sectionally U-shaped first heat exchanger, and a fluid pipe connected to the second heat exchanger is disposed at the open portion.

In the heat exchange unit as described above, the first heat exchanger is designed to have a substantially U-shaped section, the air blower is disposed substantially at the center of the first heat exchanger, the second heat exchanger is disposed at the open portion of the sectionally U-shaped first heat exchanger, and a service panel is detachably mounted at the open portion.

In the heat exchange unit as described above, a refrigerant pipe connected to the second heat exchanger is disposed along the first heat exchanger.

In the heat exchange unit as described above, the second heat exchanger has a case into which both the fluid and the refrigerant are supplied to perform heat exchange between the fluid and the refrigerant, and the upper portion of the case is provided with an outlet port for the fluid and an outlet port for the refrigerant while the lower portion of the case is provided with an inlet port for the fluid and an outlet port for the refrigerant.

In the heat exchange unit as described above, the housing has at least one support pole, and the second heat exchanger is secured to the support pole of the housing.

The heat exchange unit as described above further includes a holding member for holding the second heat exchanger by sandwiching the second heat exchanger therebetween, wherein the housing has at least one support pole, and the holding member is secured to the support pole of the housing.

BRIEF DESCRIPTION OF THE DRAWINGS

FIG. 2 is a diagram showing an operation status of a compressor shown in FIG. 1;

FIG. 3 is a diagram showing an opening/closing status of an opening/closing valve shown in FIG. 1;

FIG. 12 is a diagram showing a heat exchange efficiency of the second heat exchanger shown in FIG. 11;

DETAILED DESCRIPTION OF THE PREFERRED EMBODIMENTS

Preferred embodiments according to the present invention will be described hereunder with reference to the accompanying drawings.

Figure 1:
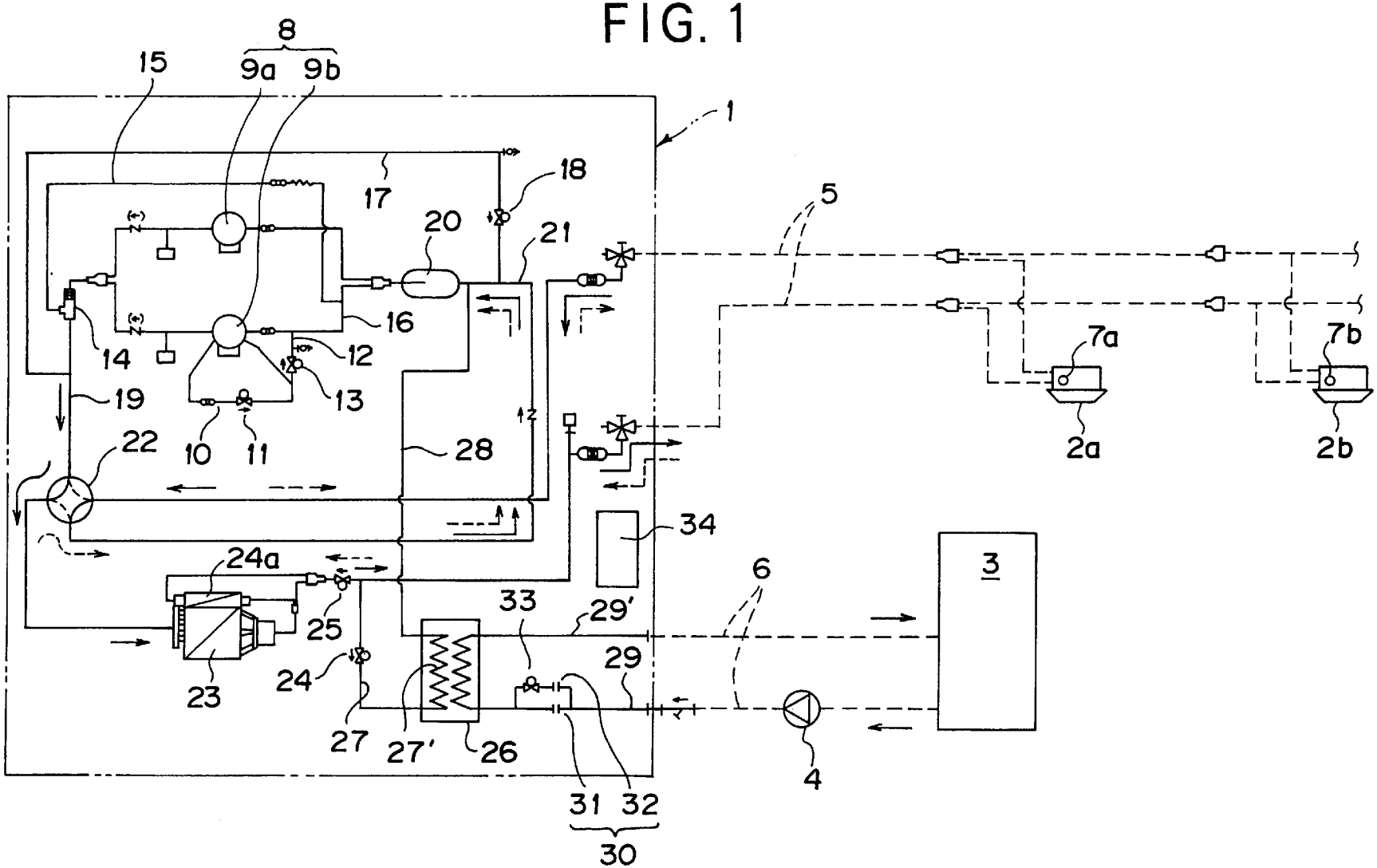
FIG. 1 is a refrigerant circuit diagram of an air conditioning system of the present invention.

FIG. 1 shows an air conditioning system having an air conditioner according to an embodiment of the present invention. The air conditioning system includes an outdoor unit 1, two indoor units 2*a* and 2*b*, a boiler (hot water source) 3, and a circulating pump 4. Reference numeral 5 represents an inter-unit pipe for connecting the units 1, 2*a* and 2*b*, and reference numeral 6 represents a brine pipe in which the circulating pump 4 is disposed.

Each of the indoor units 2*a* and 2*b* is equipped with an indoor heat exchanger (not shown), a temperature sensor (not shown) for detecting the temperature of the indoor heat exchanger in heating operation (the condensation temperature in heating operation), an expansion device (not shown), and an indoor sensor 7*a* (7*b*) for detecting an air conditioning load of a room. Reference numeral 3 represents a boiler for heating fluid such as water or the like. A heater (not shown) for heating brine is built in the boiler 3, and the heated brine is allowed to flow in a direction as indicated by a solid line by operating the circulating pump 4. In this embodiment, the circulating pump 4 is built in neither the outdoor unit 1 nor the boiler 3, however, it may be built in any one of the outdoor unit 1 and the boiler 3.

The outdoor unit 1 is equipped with various elements as described below. That is, reference numeral 8 represents a compressing apparatus, and it comprises two compressors 9*a* and 9*b*. The compressor 9*a* is designed as a power (capacity)-invariable type having 6 horsepowers, and the compressor 9*b* is designed as a power (capacity)-variable type having 4 horsepowers at maximum. Reference numeral 10 represents a high-pressure pipe having a high-pressure open/close valve 11 connected to the compressor 9*b*. By opening the high-pressure open/close valve 11, high pressure in a refrigeration cycle is applied to the compressor 9*b* to set the power (capacity) of the compressor 9*b* to 4 horsepowers. Reference numeral 12 represents a low-pressure pipe having a low-pressure open/close valve 13 connected to the compressor 9*b*. By opening the low-pressure open/close valve 13, low pressure in the refrigeration cycle is applied to the compressor 9*b* to set the power (capacity) of the compressor 9*b* to 2 horsepowers.

Reference numeral 14 represents an oil separator, and it is provided in a discharge pipe 19. Oil which is separated in the oil separator 14 is returned through an oil pipe 15 to a suck-in pipe 16 of the compressor 9*b*. Reference numeral 17 represents a bypass pipe having a bypass valve 18 for adjusting the power, and it is adapted to connect the discharge pipe 19 and a suck-in pipe 21 at the front stage of an accumulator 20. By opening the bypass valve 18, the refrigerant at high pressure side under the refrigeration cycle is returned to low pressure side under the refrigeration cycle, whereby the power of the compressing apparatus 8 is reduced by 1 horsepower. Reference numeral 22 represents a four-way change-over valve. The four-way change-over valve is set to a switching state as indicated by a broken line under heating operation, and to a switching state as indicated by a solid line under cooling operation.

Reference numeral 23 represents an outdoor heat exchanger (first heat exchanger), and reference numeral 24*a* represents a frost preventing coil which is disposed at the lower side of the outdoor heat exchanger 23. The outdoor heat exchanger is connected as shown in FIG. 1 by a refrigerant pipe. Reference numeral 24 represents a heating open/close valve. It is set to a full-open state when a refrigerant heater (second heat exchanger) as described later is used (in heating operation using no heat pump), and it is set to a full-close state in cooling operation. Reference numeral 25 represents a cooling open/close valve. It is set to a full-open state in both cooling operation and heating operation using the heat pump), and it is set to a full-close state in heating operation using no heat pump.

Reference numeral 26 represents the refrigerant heater (second heat exchanger), and hot water which is heated by the boiler 3 is heat-exchanged with the refrigerant in the second heat exchanger 26. An inlet pipe 27 of a refrigerant pipe 27' of the refrigerant heater 26 is connected to the high-pressure pipe of the refrigeration cycle through the heating open/close valve 24, and an output pipe 28 is connected to the suck-in pipe at the front stage of the accumulator 20.

An inlet pipe 29 of the brine pipe 6, that is, an inlet pipe through which fluid (e.g., hot water) is supplied into the second heat exchanger 26, is provided with a plurality of control valves (constant flow-amount valve) 30 which are disposed in parallel to each other and adapted to adjust the amount of the fluid (hot water) to be supplied to the second heat exchanger 26. These control valves (first and second constant flow-amount valves 31 and 32) function as flow amount adjusting means (the feature of the present invention) in combination.

Specifically, the first constant flow-amount valve 31 functions to adjust the flow amount of brine so that brine is supplied at 75 liter/minute to the second heat exchanger 26 even when a large amount of brine (hot water) flows from the boiler 3. Further, the second constant flow-amount valve 32 functions to adjust the flow amount of brine so that brine is supplied to at 4 liter/minute to the second heat exchanger 26 even when a large amount of brine (hot water) flows from the boiler 3. The supply amount of the brine to the second heat exchanger as described above is not limited to the above specific values, and these values may be determined in accordance with various factors. Reference numeral 33 represents an open/close valve which is provided at the inlet side of the second constant flow-amount valve 32, and the open/close operation of the valve is controlled in accordance with an air conditioning load. That is, by the opening the open/close valve 33, brine of 11.5 liter/minute flows into the second heat exchanger 26. On the other hand, by closing the open/close valve 33, brine of 4 liter/minute flows into the second heat exchanger 26. This construction is a feature of the present invention, and the operation thereof will be described later.

Reference numeral 34 represents a controller for the air conditioning system as described above. The controller 34 receives signals from the temperature sensors and the indoor sensors 7*a* and 7*b* of the indoor units 2*a* and 2*b* to set a driving horsepower for the air conditioning system. The driving power of the compressing apparatus 8 and the open/close state of the bypass valve 18 of the bypass pipe 17 are set as shown in FIG. 2 in accordance with the set driving horsepower, whereby the power of the air conditioning system can be varied stepwise every 1 horsepower.

Here, in the cooling operation, the refrigerant discharged from the compressing apparatus 8 flows as indicated by a solid arrow of FIG. 1, and the indoor heat exchanger (not shown) acts as an evaporator. At this time, the cooling open/close valve 25 is set to the full-open state while the heating open/close valve 24 is set to the full-close state, and the use of the second heat exchanger 26 is ceased.

On the other hand, in the heating operation, the refrigerant discharged from the compressing apparatus 8 flows as indicated by a broken-line arrow, and the indoor heat exchanger (not show) acts as a condenser. At this time, if the outside temperature is above a predetermined temperature and thus it is judged that only the heat-pump operation can provide sufficient heating power, like the cooling operation, the cooling open/close valve 25 is fully opened and the heating open/close valve 24 is fully closed on the basis of the signal from the controller 34, whereby the use of the second heat exchanger 26 is ceased. However, if the outside temperature is below the predetermined temperature and thus it is judged that only the heat-pump operation cannot provide sufficient heating power, the cooling open/close valve 25 is fully closed and the heating open/close valve 24 is fully opened on the basis of the signal from the controller 34, and the boiler 3 and the circulating pump 4 are driven. With this operation, the refrigerant is heated in the second heat exchanger 26 by the hot water (brine) which is heated by the boiler 3. That is, the hot water serves as heat source for heating the refrigerant.

The present invention effectively works in driving operation when the outside temperature is below the predetermined temperature and thus only the heat-pump operation cannot provide sufficient heating power. As described above, the controller first receives the signals from the temperature sensors and the indoor sensors 7*a* and 7*b* of the indoor units 2*a* and 2*b* to set the driving power of the air conditioning system. In accordance with the set driving power, the driving power of the compressing apparatus 8 and the open/close state of the bypass valve 18 of the bypass pipe 17 are set as shown in FIG. 2. At the same time, the open/close state of the open/close valve 33 is set as shown in FIG. 3 on the basis of the relationship between the number of operating indoor units (2*a*,2*b*) and the condensation temperature (condensation temperature in heating operation) of the indoor units 2*a* and 2*b*. That is, when the number of indoor units to be operated is small and the condensation temperature is above a predetermined temperature, it is judged that sufficient refrigerant heat amount is obtained by brine, and the open/close valve 33 is closed, whereby brine of 4 liter/minute flows into the second heat exchanger 26.

On the other hand, when the number of indoor units to be operated is large and the condensation temperature is below the predetermined temperature, it is judged that no sufficient refrigerant heat amount is obtained by brine, and the open/close valve 33 is opened, whereby brine of 11.5 liter/minute flows into the second heat exchanger 26.

As described above, the power of the compressing apparatus 8 and the amount of brine to flow into the second heat exchanger 26 are adjusted in accordance with the number of operating indoor units (2*a*, 2*b*) and the condensation temperature (air conditioning load). Accordingly, the power of the compressing apparatus 8 and the heat amount of the refrigerant which are matched with the air conditioning load can be obtained.

Figure 4:
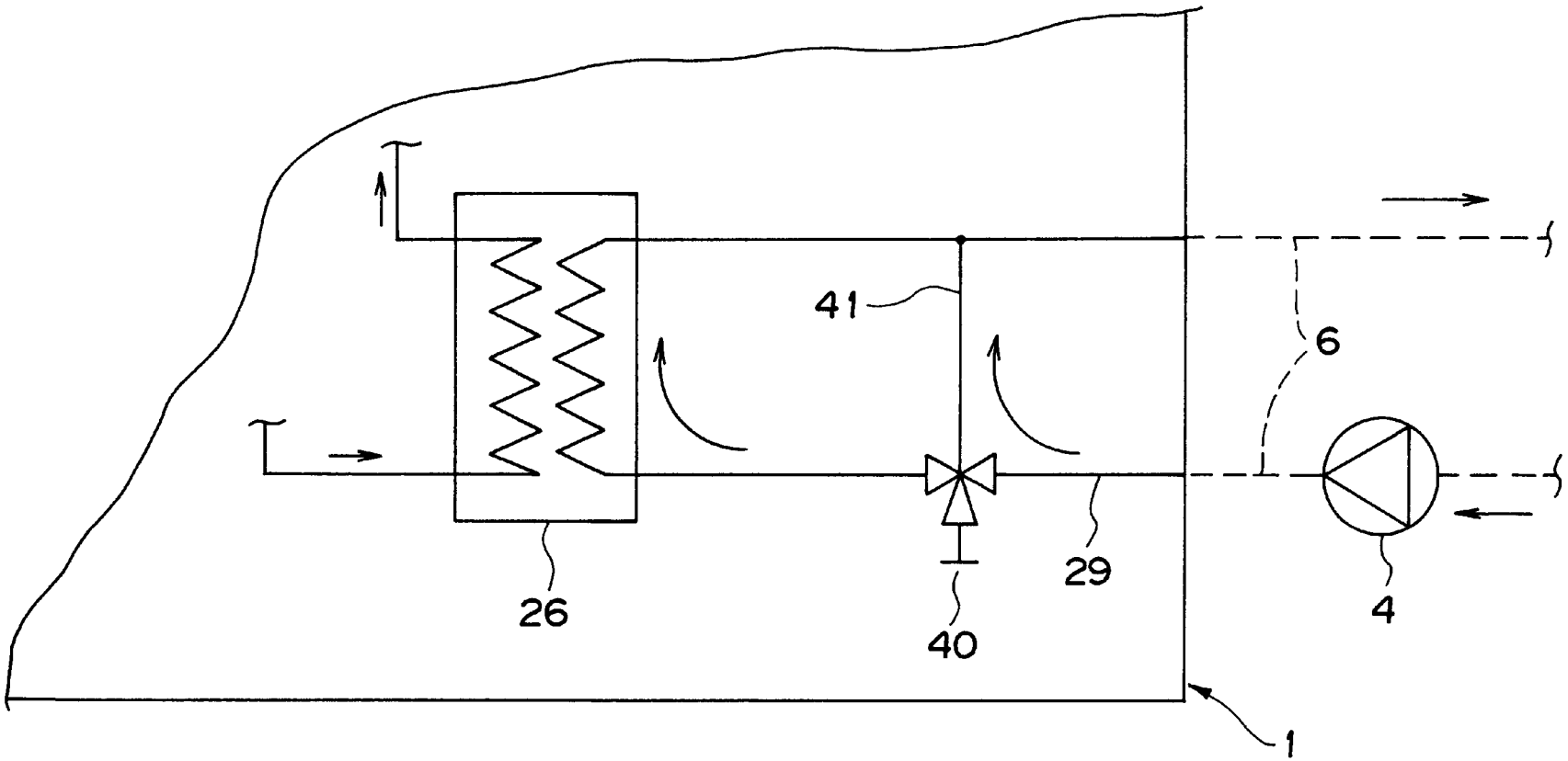
FIG. 4 is a first modification of fluid amount adjusting means of the refrigerant circuit shown in FIG. 1.

FIG. 4 shows a first modification of the fluid amount adjusting means shown in FIG. 1. As shown in FIG. 4, a three-way change-over valve 40 is provided to the inlet pipe 29 of the brine. One outlet pipe 41 of the three-way change-over valve 40 is connected to the brine pipe 6 so as to bypass the second exchanger 26. Accordingly, when the refrigerant heat amount in the second heat exchanger 26 is sufficient, the brine may be allowed to flow into the one outlet pipe 41 while bypassing the second heat exchanger 26.

Figure 5:
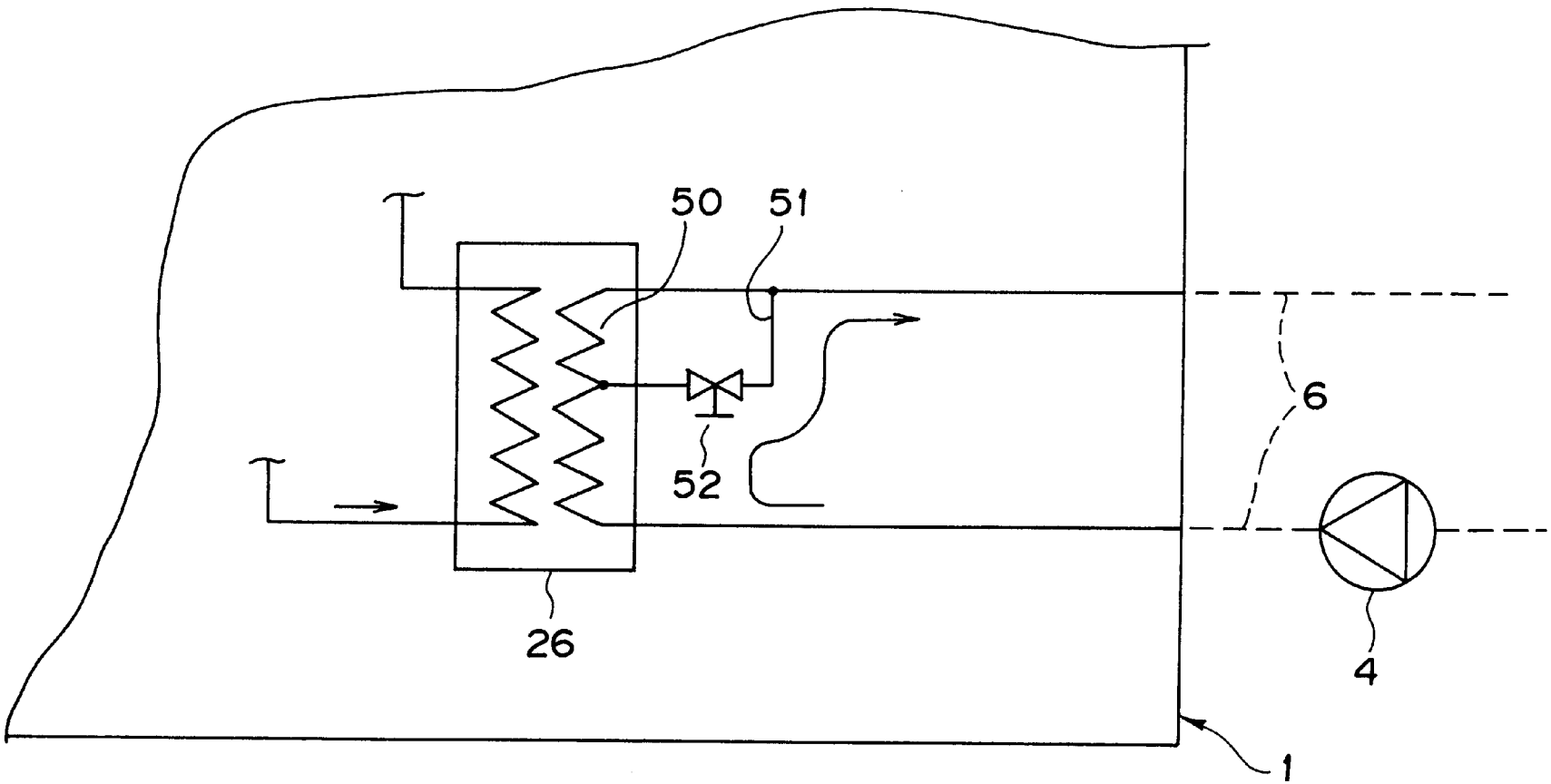
FIG. 5 is a second modification of the fluid amount adjusting means of the refrigerant circuit shown in FIG. 1.

Further, FIG. 5 shows a second modification of the fluid amount adjusting means shown in FIG. 1. As shown in FIG. 5, a bypass pipe 51 for bypassing a part 50 of the second heat exchanger 26 (for example, a part of a fluid passage) is provided as the fluid amount adjusting means. In this modification, when the refrigerant heat amount in the second heat exchanger 26 is sufficient, an open/close valve 52 provided in the bypass pipe 51 is opened to prevent the brine from flowing into a part 50 of the second heat exchanger 26, thereby adjusting the flow amount in the second heat exchanger 26.

Figure 6:
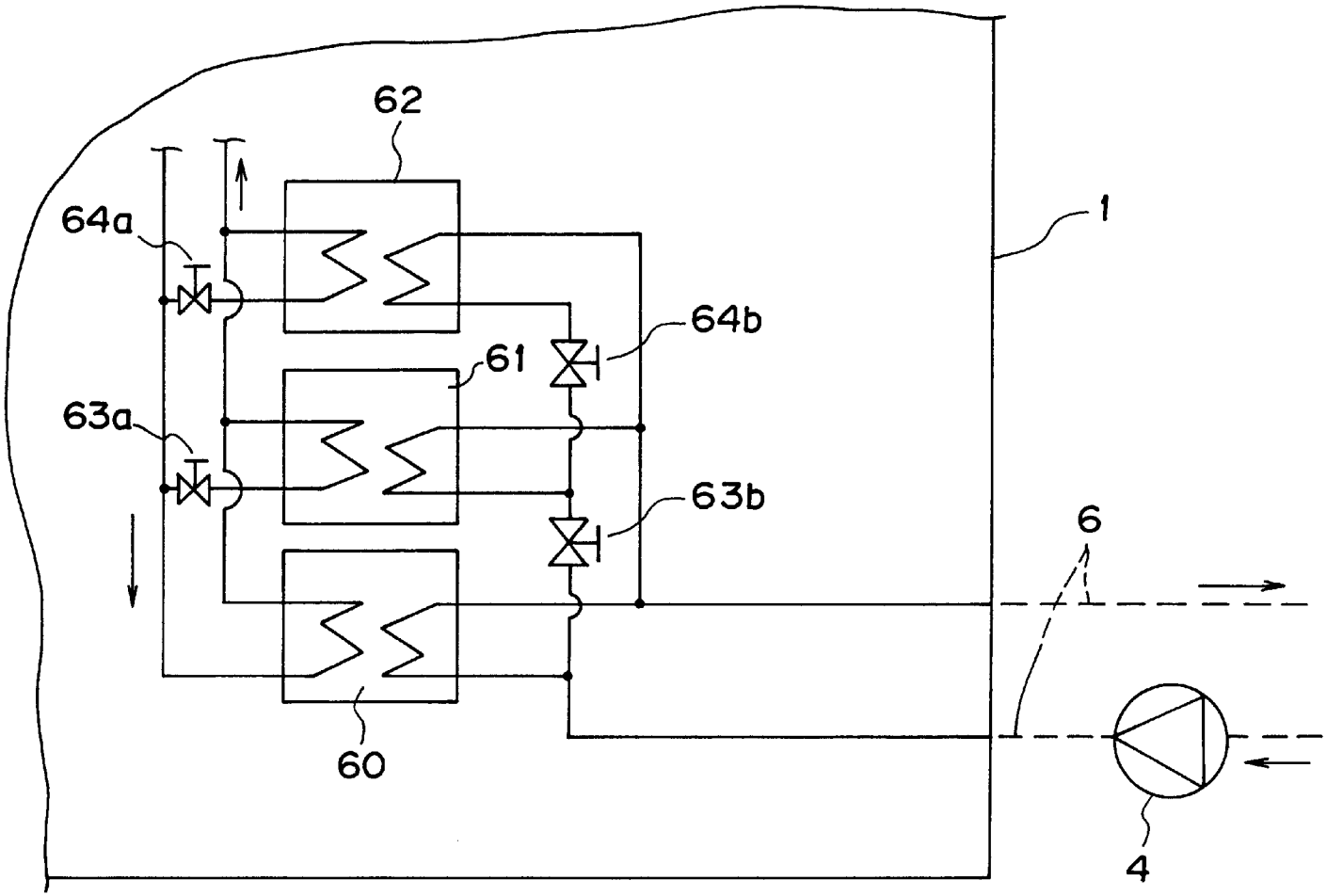
FIG. 6 is a third modification of the fluid amount adjusting means of the refrigerant circuit shown in FIG. 1.

FIG. 6 shows a third modification of the fluid amount adjusting means shown in FIG. 1. In this modification, the second heat exchanger 26 is divided into plural heat exchangers 60, 61 and 62 as shown in FIG. 6. A pair of open/close valves 63*a* (64*a*) and 63*b* (64*b*) are interposed between the respective heat exchangers, and the brine is allowed to flow into only desired heat exchangers by controlling the open/close operation of the open/close valves.

According to the embodiment and the modifications thereof as described above, the air conditioner is equipped with the second heat exchanger which is supplied with the refrigerant from the first heat exchanger serving as the air heat source and the heated fluid such as hot water or the like from the boiler 3 to heat the refrigerant, and the amount of the fluid to be supplied to the second heat exchanger is controlled by the fluid amount adjusting means. Therefore, it is sufficient to provide the air conditioner with only the second heat exchanger for heating the refrigerant and the controller for adjusting the amount of the fluid to be supplied to the second heat exchanger. Accordingly, the design time can be shortened, and the increase in number of parts can be suppressed. Further, the mechanism for adjusting the amount of the fluid to be supplied to the second heat exchanger is originally installed in the air conditioner. Therefore, a boiler and a circulating pump which are generally and broadly used may be used as the boiler 3 and the circulating pump 4 which are connected to the air conditioner, so that the degree of freedom in design of the air conditioner can be enhanced.

Further, the amount of the fluid to be supplied to the second heat exchanger is adjusted in accordance with the air conditioning load. The adjustment of the amount of the fluid to be supplied to the second heat exchanger may be performed by adjusting the size (dimension) of the second heat exchanger (for example, the length, the section area or the like of the fluid passage). In this case, the size of the second heat exchanger is preferably adjusted in accordance with the air conditioning load.

Still further, the air conditioning system according to the present invention is equipped with the outdoor unit having the first heat exchanger serving as the air heat source, and the second heat exchanger which is supplied with the heated fluid such as hot water or the like to heat the refrigerant from the first heat exchanger 23, the plural indoor units which are connected to the outdoor unit, and the boiler which is connected to the second heat exchanger through the circulating pump and adapted to heat the fluid. The inlet pipe of the brine pipe connected to the boiler is provided with the mechanism for adjusting the amount of the fluid to be supplied to the second heat exchanger, whereby the refrigerant is heated in accordance with the number of indoor units to be operated and the air conditioning load.

Still further, the air conditioner of the present invention is equipped with the compressing apparatus, the indoor heat exchanger, the expansion device, and the heat exchanger which is supplied with the fluid such as hot water or the like to heat the refrigerant, wherein the compressing apparatus is designed so that the power(capacity) thereof is variable, the controller for adjusting the amount of the fluid to be supplied to the heat exchanger is provided, and the power of the compressing apparatus and the amount of the fluid to be supplied to the heat exchanger are adjusted in accordance with the air conditioning load of the room, whereby the power of the compressing apparatus and the amount of the fluid to be supplied to the heat exchanger are controlled in accordance with the air conditioning load.

Still further, the air conditioner of the present invention is equipped with the first heat exchanger serving as the air heat source, the second heat exchanger which is supplied with the fluid such as hot water or the like to heat the refrigerant, and the plural control valves which are provided in the inlet pipe of the brine pipe for supplying the fluid to the second heat exchanger and adapted to adjust the amount of the fluid to be supplied to the second heat exchanger. Accordingly, since there are provided a plurality of control valves, each control valve can be designed in a compact size.

Figure 7:
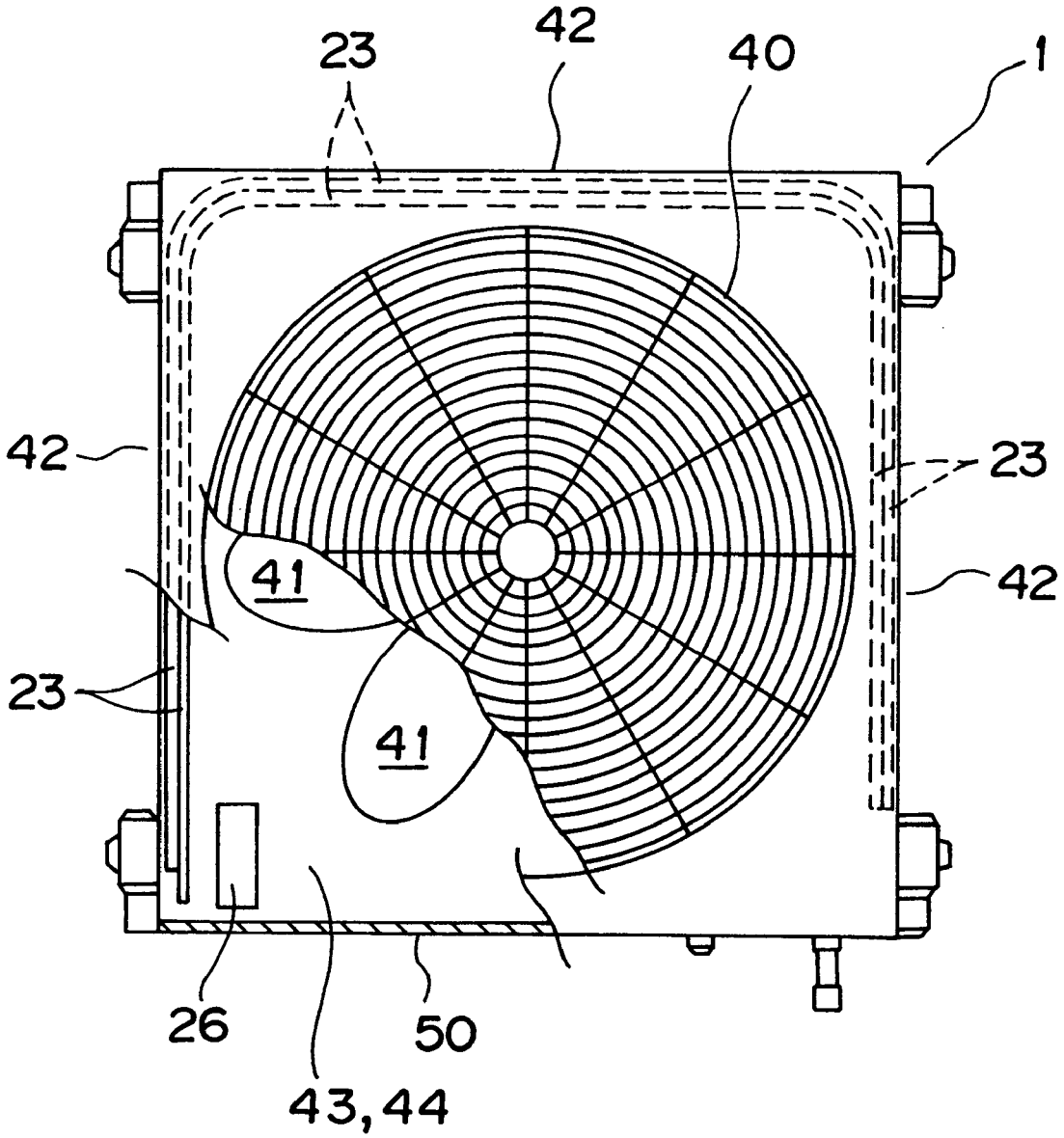
FIG. 7 is a plan view showing an outdoor heat exchange unit shown in FIG. 1.
Figure 8:
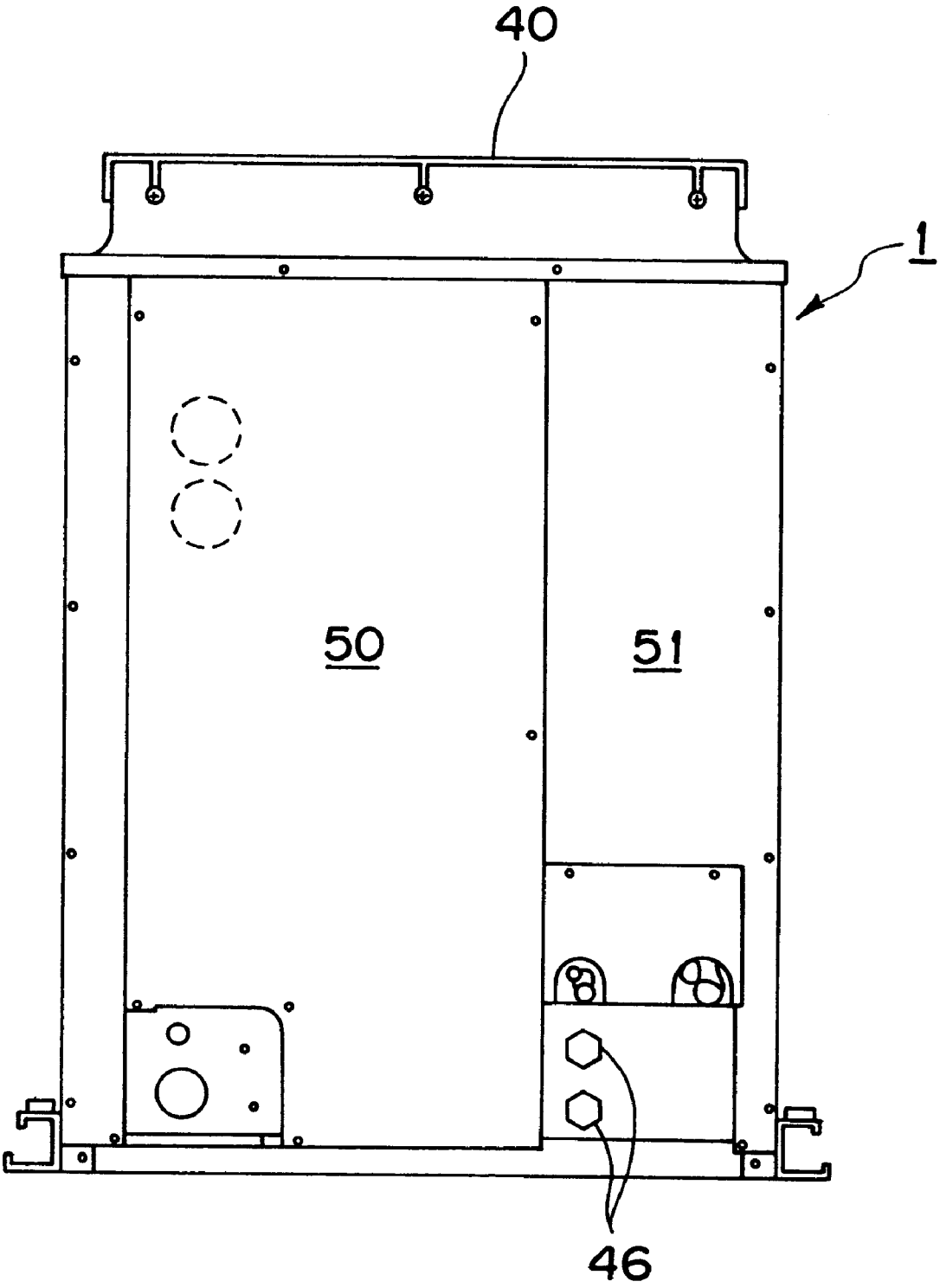
FIG. 8 is a side view showing the outdoor heat exchange unit shown in FIG. 1.
Figure 9:
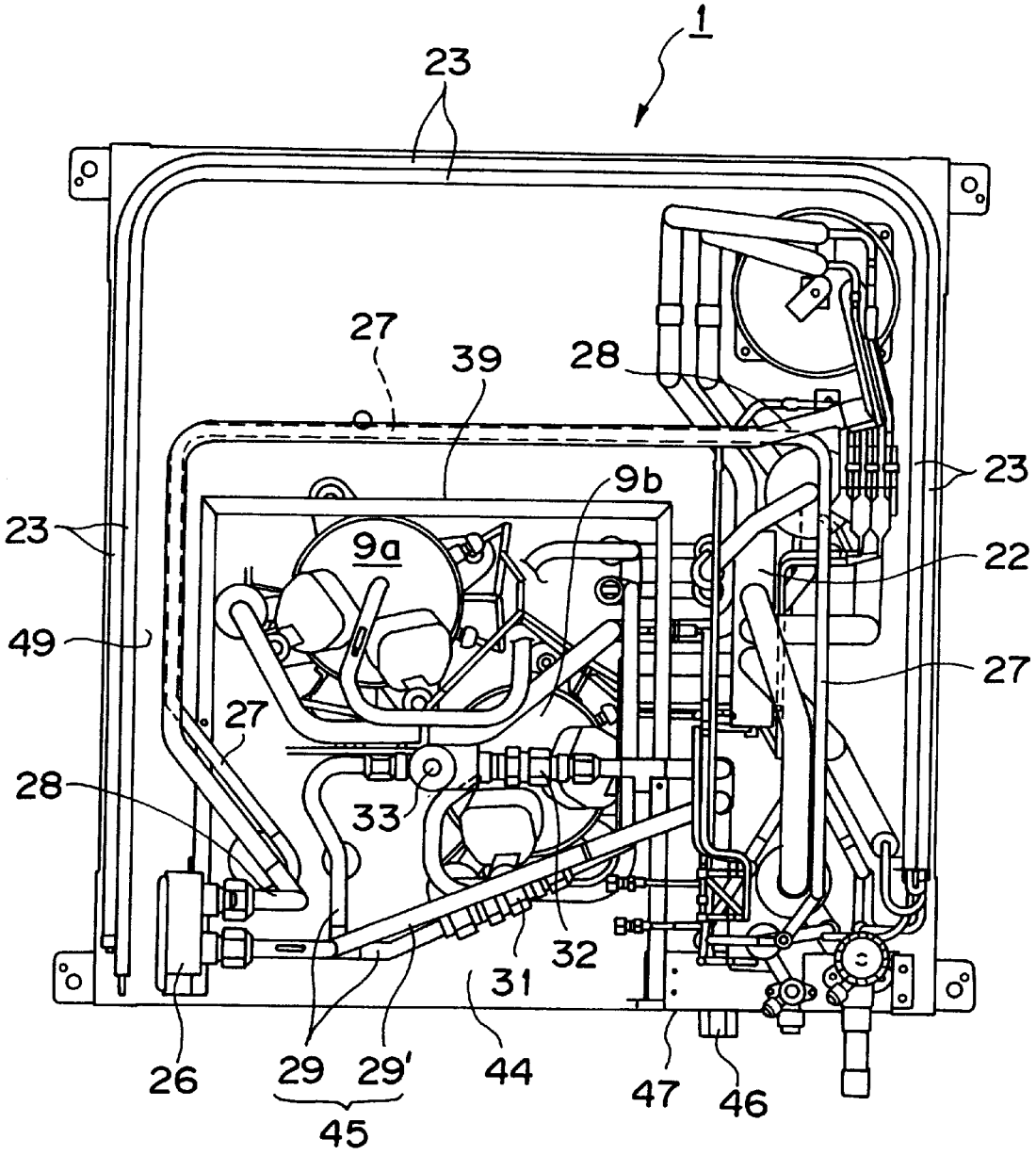
FIG. 9 is a plan view showing the internal structure of the outdoor heat exchanger unit shown in FIG. 1.
Figure 10:
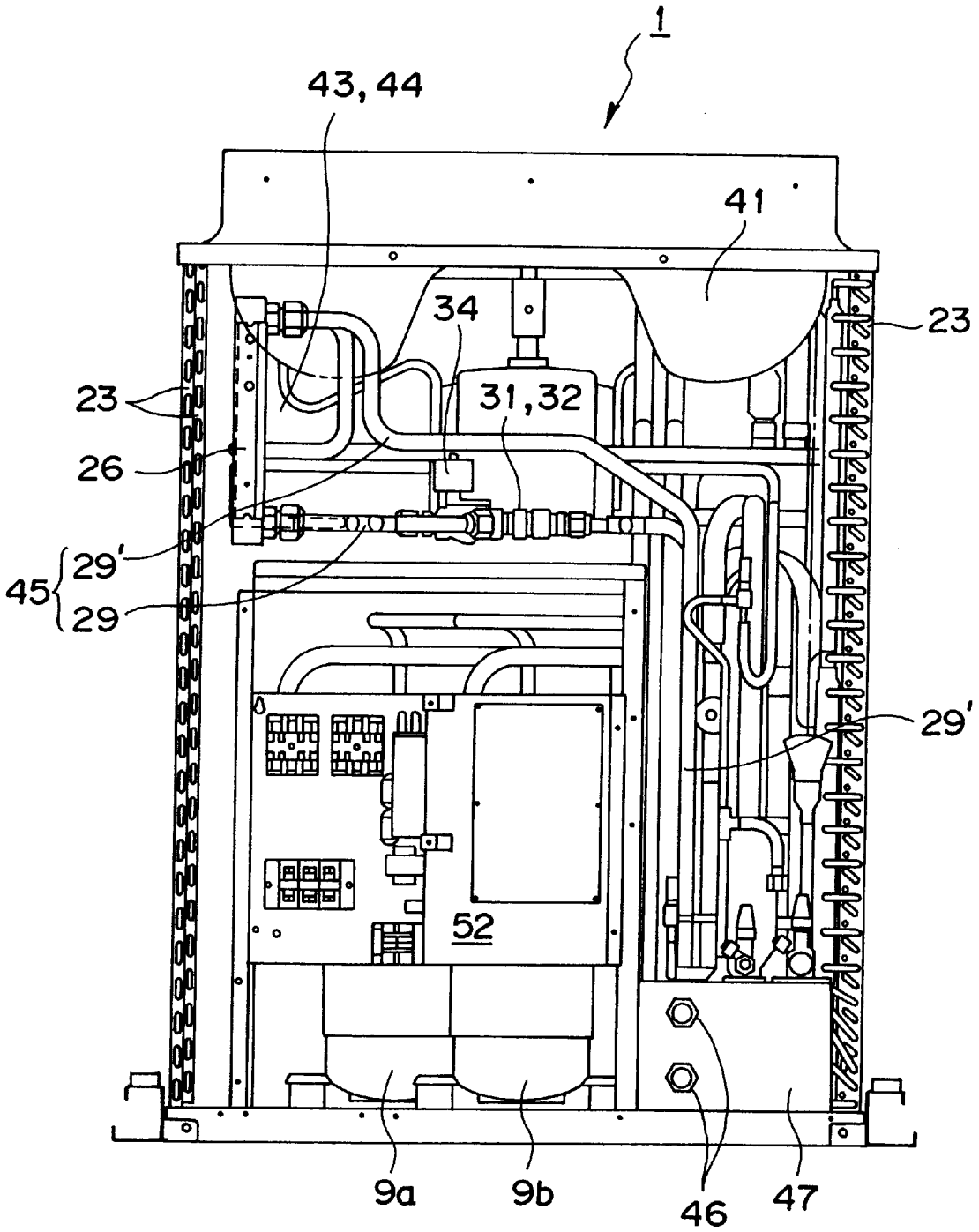
FIG. 10 is a longitudinal sectional view showing the internal structure of the heat exchanger unit shown in FIG. 1.

FIGS. 7 to 10 show the arrangement construction of the outdoor unit as described above. Specifically, FIG. 7 is a plan view, FIG. 8 is a side view, FIG. 9 is a plan view showing the internal structure of the outdoor unit when a top plate is detached from a mechanical chamber (room) 39 where a propeller fan (as described later) and the compressing apparatus 8 are accommodated, and FIG. 10 is a side view showing the internal structure when a side face panel of the outdoor unit is detached.

Referring to FIG. 7, the outdoor unit is designed in a substantially rectangular shape in section, and an air blow-out grill 40 is secured to the upper surface of the outdoor unit 1. By operating the propeller fan (air blower) 41 disposed at the center of the upper portion in the outdoor unit 1, the outside air is sucked into three side surfaces 42 of the outdoor unit 1, and discharged from the air blow-out grill 40. The first heat exchanger 23 serving as the air heat source is disposed so as to surround the air blower 41 while opening at least a part of the surrounding to the air blower 41. In other words, the first heat exchanger 23 serving as the air heat source comprises a two-array plate fin type heat exchanger having U-shape section, and the air blower 41 is disposed at the center portion of the U-shaped heat exchanger. 23. The second heat exchanger 26 which is supplied with fluid such as hot water to heat the refrigerant is disposed in a surplus space 43 which is formed by the first heat exchanger 23 and the air blower 41. More specifically, the second heat exchanger 26 is disposed at an open portion 44 of the first heat exchanger 23.

Further, as shown in FIG. 9, a water pipe 45 (inlet pipe 29 and outlet pipe 29' of brine) which is connected to the second heat exchanger 26 is disposed along the open portion 44. The end portions 46 of the water pipe 45 are guided to the side surface 48 of a valve stage 47, and then connected to the brine pipe 6.

The inlet pipe 27 and the outlet pipe 28 of the refrigerant pipe 27' which is connected to the second heat exchanger 26 are disposed partially along one side 49 of the first heat exchanger 23 of U-shape in section. Here, the water pipe 45 (brine pipe 6) is disposed at the front side of the inlet and outlet pipes 27 and 28 of the refrigerant pipe 27' in the outdoor unit as shown in FIG. 9. This is because the water pipe 45 is provided with the two constant flow-amount valves 31 and 32 and thus the frequency of a service work for the water pipe 45 seems to be higher than that of the inlet and outlet pipes 27 and 28 of the refrigerant pipe 27'. Therefore, the service work (maintenance, water supplement, etc.) can be more easily performed on the water pipe 45.

Referring to FIG. 8, reference numeral 50 represents a large service panel, and reference numeral 51 represents a small service panel. Both the service panels 50 and 51 are detachably secured to the side portion of the outdoor unit 1. FIG. 10 shows the outdoor unit when the service panels 50 and 51 are detached. Particularly when the large service panel 50 is detached, an operator can directly see the water pipe 45 having the two constant flow-amount valves 31 and 32 and an electrical box plate 52 which is disposed to extend over the front surface of the mechanical chamber 39. In other words, the service panel 50 is detachably disposed at the open portion 44 of the sectionally U-shaped first heat exchanger 23.

In FIGS. 7 to 10, the same elements as shown in FIG. 1 are represented by the same reference numerals, and the description thereof is omitted. Further, the mount structure of the second heat exchanger 26 is omitted from FIG. 7 because it will be described later.

According to this embodiment, the second heat exchanger which is supplied with the fluid such as hot water to the like is disposed in the surplus space which is formed by the first heat exchanger serving as the air heat source and the air blower for promoting the heat exchange between air and the refrigerant flowing in the first heat exchanger. Therefore, a space which is exclusively used to accommodate the second heat exchanger is unnecessary in the outdoor unit, and thus it is unnecessary to design the housing (outdoor unit) in large size.

Further, the first heat exchanger serving as the air heat source is disposed so as to open at least one side thereof which surrounds the air blower, and the second heat exchanger is disposed at the open portion of the first heat exchanger. Therefore, the second heat exchanger and the first heat exchanger are disposed effectively in the outdoor unit, and thus the large-size design of the housing (outdoor unit) can be further suppressed.

Still further, the first heat exchanger is designed to have a substantially U-shape section, the air blower for promoting the heat exchange between the air and the refrigerant flowing in the first heat exchanger is disposed substantially at the center of the first heat exchanger, the second heat exchanger for heating the refrigerant by supplying the fluid such as hot water into the second heat exchanger is disposed at the open portion of the sectionally U-shaped first heat exchanger, and the water pipe (brine pipe) connected to the second heat exchanger is disposed at the open portion of the first heat exchanger. Therefore, the maintenance service of the second heat exchanger is more facilitated.

Further, the air blower and the first heat exchanger serving as the air heat source which is disposed so as to open at least one side of the surrounding of the air blower, the second heat exchanger which is supplied with the fluid such as hot water to heat the refrigerant is disposed at the open portion of the first heat exchanger, the water pipe connected to the second heat exchanger is disposed at the open portion of the first heat exchanger, and the refrigerant pipe connected to the second heat exchanger is disposed along the first heat exchanger. Therefore, the open portion of the first heat exchanger can be used as a service check space for the water pipe connected to the second heat exchanger, and thus the large-scale design of the housing (outdoor unit) can be suppressed.

The air blower for promoting the heat exchange between the air and the refrigerant flowing in the first heat exchanger is disposed substantially at the center of the sectionally U-shaped first heat exchanger serving as the air heat source, the second heat exchanger for heating the refrigerant while supplied with the fluid such as hot water or the like is disposed at the open portion of the sectionally U-shaped first heat exchanger, and the service panel is detachably secured at the opening portion. Therefore, by detaching the service panel, the service check of the second heat exchanger can be simply performed.

Figure 11:
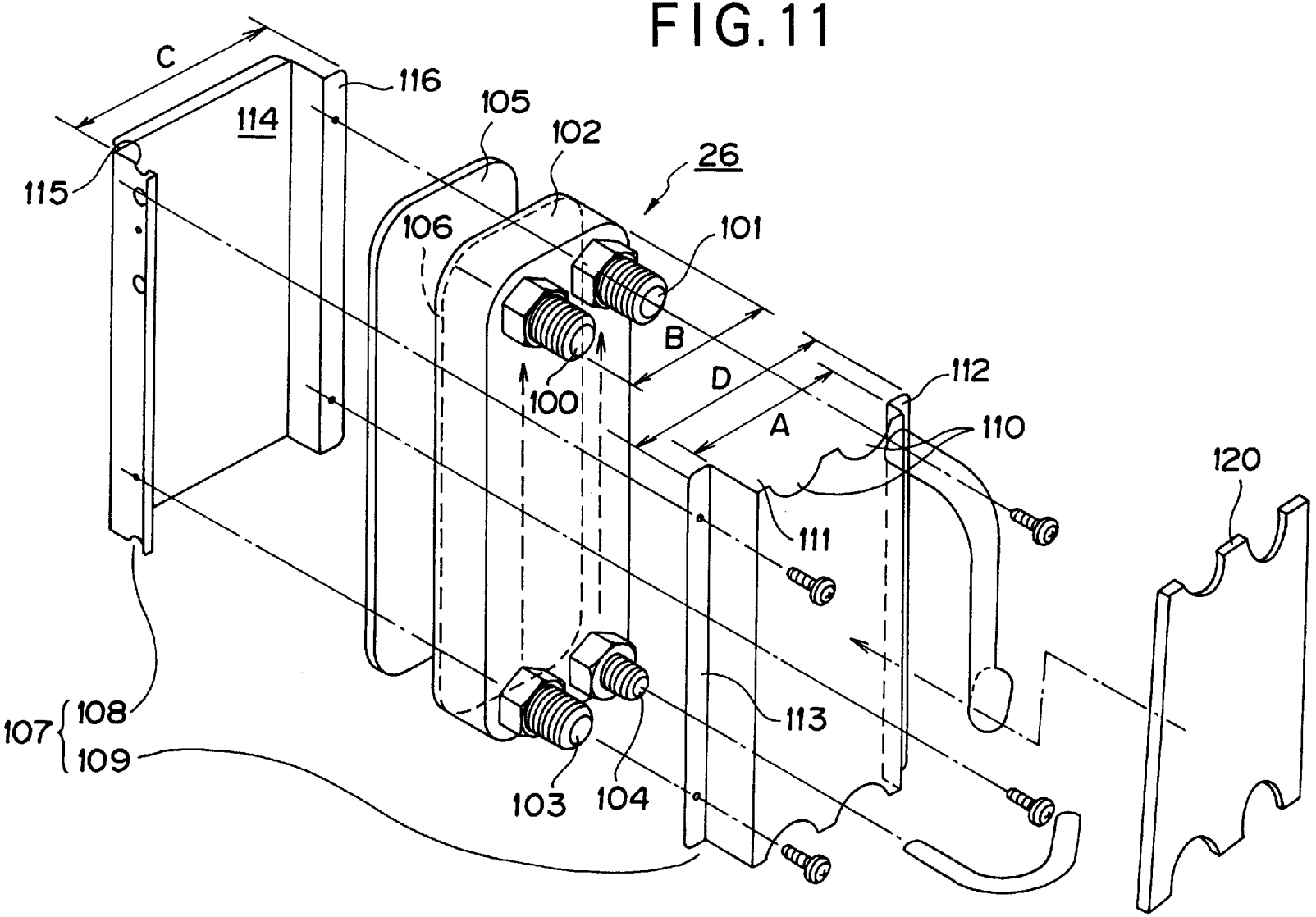
FIG. 11 is an exploded perspective view of a second heat exchanger.

FIG. 11 is an exploded perspective view showing the second heat exchanger 26.

Figure 14:
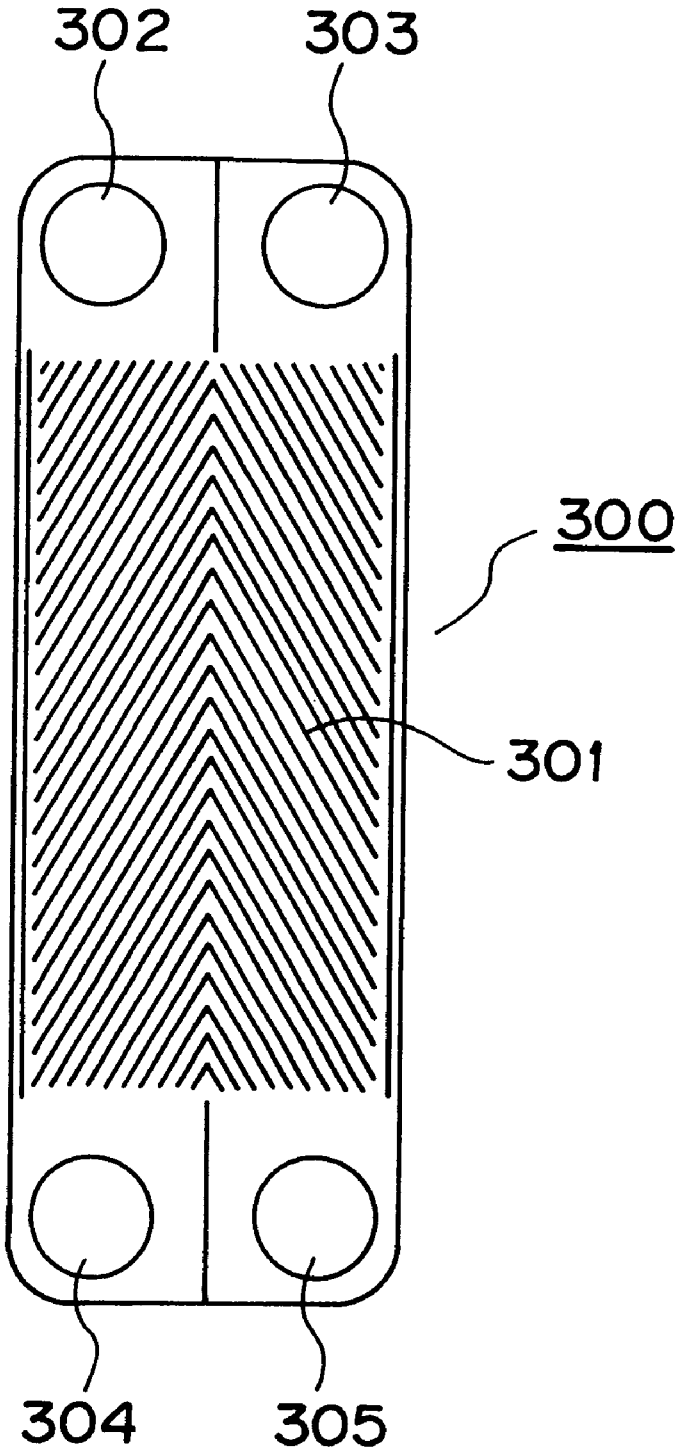
FIG. 14 is a diagram showing a laminate metal plate which is provided in a case of the second heat exchanger shown in FIG. 11.

A plurality of metal plates 300 shown in FIG. 14 are accommodated in a case 102 of the second heat exchanger 26 while being alternately laid face up and down. As show in FIG. 14, the metal plates 300 are formed by a press molding method, and each metal plate has an uneven portion at which ridges constituting a projecting portion are obliquely formed toward the center axis. Openings 302, 303, 304 and 305 are formed at the four corners of each metal plate 300, and the peripheral portion of the openings 303 and 305 at the right side are formed so as to be higher in the vertical direction to the drawing surface. Therefore, when the metal plates are laminated while being laid alternately face up and face down, the peripheral portion of the openings at one side of a metal plate is brought into close contact with that of an adjacent metal plate, and the peripheral portion of the openings at the other side of the metal is spaced from that of the adjacent metal plate. The respective metal plates are joined to one another at the contact portions thereof by soldering, and a passage 306 for fluid (hot water) and a passage 307 for refrigerant are alternately formed in gaps between the metal plates 300 as show in FIG. 15.

As shown in FIG. 11, an outlet port 100 for fluid (hot water) and an outlet port 101 for refrigerant are provided at the upper portion of the case 102 while an inlet port 103 for the fluid (hot water) and an inlet port 104 for the refrigerant are provide at the lower portion of the case 102. The fluid inlet and outlet ports 103 and 100 intercommunicate with the passage 306 for the fluid (hot water), and the refrigerant inlet and outlet ports 104 and 101 intercommunicate with the passage 307 for the refrigerant.

Figure 15:
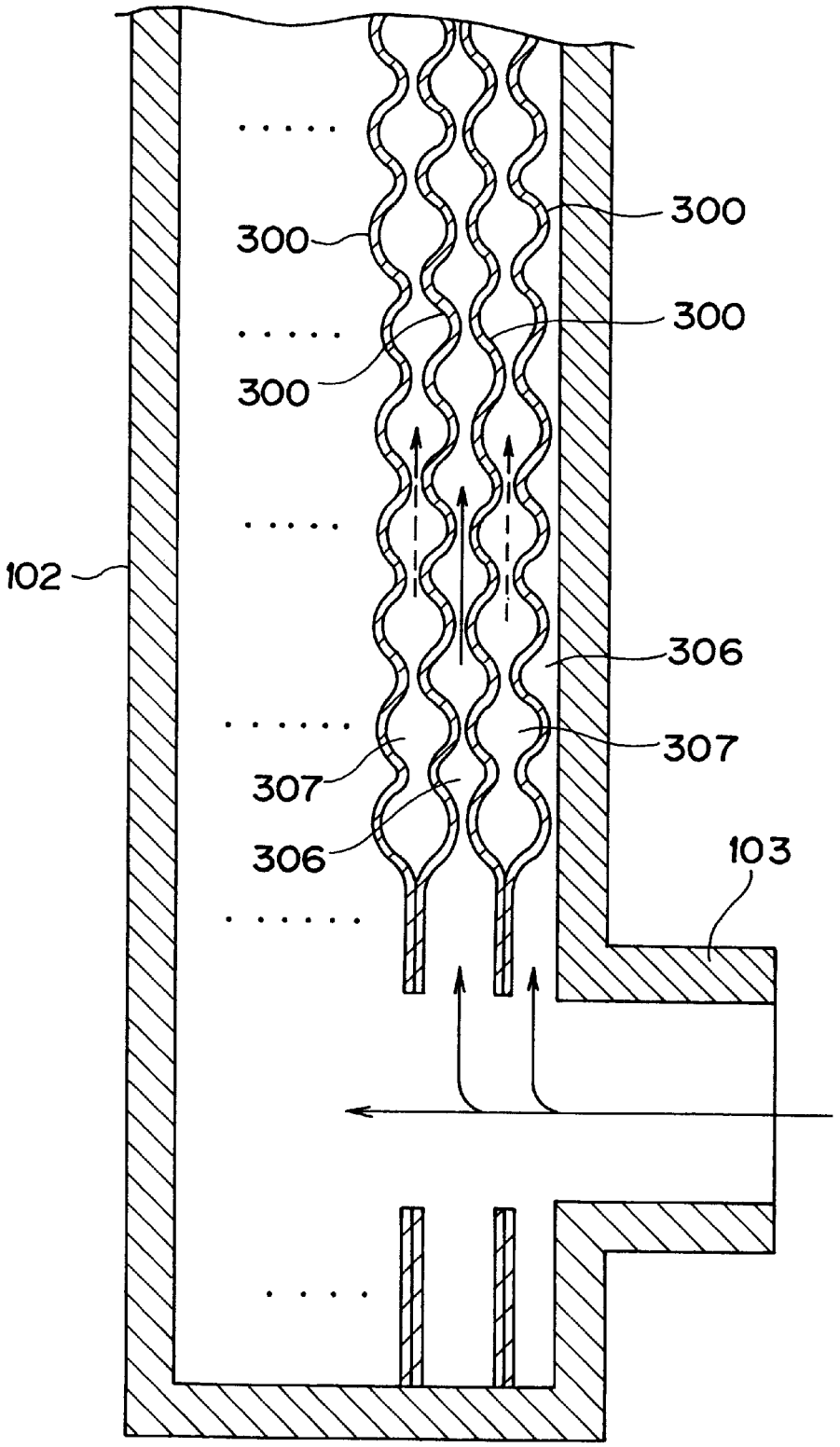
FIG. 15 is a diagram showing a heat-source water passage and a refrigerant passage which are formed by the laminate metal plate shown in FIG. 14.

The fluid which is supplied from the fluid inlet port 103 flows through the fluid passage 306 in a direction as indicated by a solid arrow of FIG. 15 while spreading in the vertical direction to the surface of the drawing. On the other hand, the refrigerant which is supplied from the refrigerant inlet port 104 flows through the refrigerant passage 307 in a direction as indicated by a broken line of FIG. 15 while spreading in the vertical direction to the surface of the drawing. Accordingly, the refrigerant is heated by the heated fluid (hot water) by allowing the heated fluid and the refrigerant to flow as described above.

The fluid and the refrigerant flow in a parallel direction, i.e., a so-called "parallel-flow relationship" in which both the fluid and the refrigerant flow from the upper side to the lower side is established between the fluid and the refrigerant. This is one feature of the present invention. FIG. 12 shows a comparison experiment result between the "parallel-flow" and "counter-flow" in which the fluid and the refrigerant flow in opposite directions. As shown in FIG. 12, the "parallel-flow" enhances the power by 4.7% as compared with the "counter-flow".

Returning to FIG. 11, reference numeral 105 represents a first adiabatic member, and it is accommodated in a recess portion of the second heat exchanger 24. Reference numeral 107 represents a holding member. The holding member 107 comprises a sectionally U-shaped first holding member 108 and a sectionally U-shaped second holding member 109, and it holds the second heat exchanger 26 while sandwiching the second heat exchanger 26 between the first and second holding members 108 and 109. U-shaped notches 110 are formed at the upper and lower edges of the second holding member 109 so that the second holding member 109 is prevented from abutting against the outlet ports 100, 101 and the inlet ports 103, 104. Further, the width dimension A of a recess portion 111 of the second holding member 109 is set to be equal to the width dimension B of the second heat exchanger 26.

Further, the width dimension C of the first holding member is set to be equal to the width dimension D corresponding to the sum of the width dimension A and the width of a right securing piece 112 of the second holding member 109. Reference numeral 120 is formed of an adiabatic member, and the adiabatic member 120 is attached to the outside surface of the second holding member 109. These two adiabatic members 105 and 120 reduces the heat radiation from the second heat exchanger 26.

Next, a method of mounting the holding member 107 thus constructed will be described.

First, the first adiabatic member 105 is accommodated in the recess portion 106 of the second heat exchanger 26. Thereafter, the second holding member 109 is put to the right side surface of the second heat exchanger 26, and in this state the left side surface of the second heat exchanger 26 is put to the first holding member 108. Here, since the width dimension C of the first holding member 108 is set to the width dimension D corresponding to the sum of the width dimension A and the width of the right securing piece 112 of the second holding member 109, the left securing piece 113 of the first holding member 108 abuts against the piece 115 of the recess portion 114 of the second holding member 109 while the right securing piece 116 of the first holding member 108 abuts against the right securing piece 112 of the second holding member 109, and these members are fixed by screws, whereby the second heat exchanger 26 is fixedly sandwiched by the holding members 107.

Figure 13:
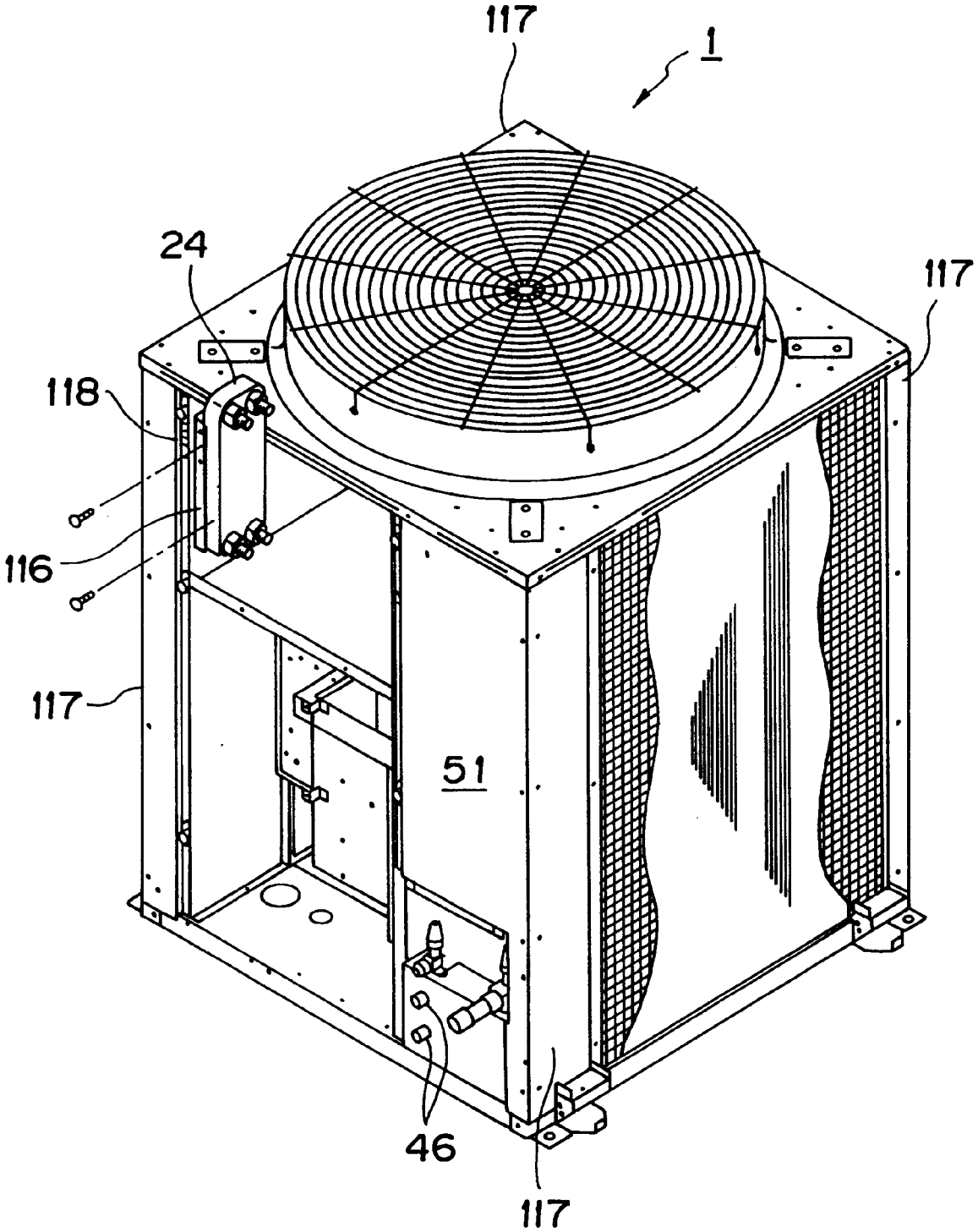
FIG. 13 is a perspective of the outdoor unit, which shows a state where a large service panel is detached.

FIG. 13 is a perspective view showing the outdoor unit when the large service panel 50 is detached from the outdoor unit. The second heat exchanger 26 which is sandwiched and held by the holding members 107 is secured to a support pole constituting the housing of the outdoor unit 1. That is, the left securing piece 116 of the first holding member 108 is fixed to the step face 118 of the support pole 117.

With the above construction, the first heat exchanger 23 serving as the air heat source is disposed along the inside of the surface of the housing, and the second heat exchanger 26 for heating the refrigerant with the heated fluid such as hot water or the like is secured to the support pole constituting the housing. The housing of the outdoor unit 1 contains four support poles 117.

According to the present invention, the heated fluid (hot water or the like) and the refrigerant are supplied in the case of the second heat exchanger to perform the heat exchange between the heated fluid and the refrigerant, and the fluid outlet port and the refrigerant outlet port are provided at the upper portion of the case while the fluid inlet port and the refrigerant outlet port are provided at the lower portion of the case. Therefore, the heat exchange efficiency of the fluid and the refrigerant can be enhanced.

Further, according to the present invention, the first heat exchanger is disposed along the inside of the surface of the housing while the second heat exchanger is secured to the support pole of the housing. Therefore, the first exchanger and the second exchanger are efficiently accommodated in the housing.

Still further, according to the present invention, the second heat exchanger for heating the refrigerant with the fluid such as hot water or the like is sandwiched and held by the holding members, and the holding members are secured to the pole of the housing. Therefore, the heat exchanger can be accommodated simply and surely in the housing.

What is claimed is:

1. An air conditioning system comprising:

an outdoor unit having a first heat exchanger serving as an air heat source for performing heat exchange between refrigerant and air, and a second heat exchanger which is supplied with a fluid to heat the refrigerant;

plural indoor units connected to said outdoor unit, the refrigerant circulating through said indoor units;

a fluid heating source which is connected said second heat exchanger through a circulating pump and adapted to heat the fluid; and fluid amount adjusting means for adjusting the amount of the heated fluid to be supplied to said second heat exchanger.

2. A heat exchange unit, including:

a first heat exchanger serving as an air heat source for performing heat exchange between refrigerant and air;

an air blower for promoting heat exchange between the air and the refrigerant flowing into said first heat exchanger;

a second heat exchanger, connected in parallel to said first heat exchanger, to which the fluid is supplied to heat the refrigerant; and a housing for accommodating said first heat exchanger, said air blower and said second heat exchanger, wherein said second heat exchanger is disposed in a surplus space which is formed by said first heat exchanger and said air blower.

3. The heat exchange unit as claimed in claim 2, wherein said first heat exchanger is disposed around said air blower so that at least a part of the surrounding of said air blower is opened, and said second heat exchanger is disposed at the open portion of said first heat exchanger.

4. The heat exchange unit as claimed in claim 2, wherein said first heat exchanger is designed to have a substantially U-shaped section, said air blower is disposed substantially at the center of said first heat exchanger, said second heat exchanger is disposed at the open portion of said sectionally U-shaped first heat exchanger, and a fluid pipe connected to said second heat exchanger is disposed at the open portion.

5. The heat exchange unit as claimed in claim 2, wherein said first heat exchanger is designed to have a substantially U-shaped section, said air blower is disposed substantially at the center of said first heat exchanger, said second heat exchanger is disposed at the open portion of said sectionally U-shaped first heat exchanger, and a service panel is detachably mounted at the open portion.

6. The heat exchange unit as claimed in claim 4, wherein a refrigerant pipe connected to said second heat exchanger is disposed along said first heat exchanger.

7. The heat exchange unit as claimed in claim 2, wherein said second heat exchanger has a case into which both the fluid and the refrigerant are supplied to perform heat exchange between the fluid and the refrigerant, and the upper portion of said case is provided with an outlet port for the fluid and an outlet port for the refrigerant while the lower portion of said case is provided with an inlet port for the fluid and an outlet port for the refrigerant.

8. The heat exchange unit as claimed in claim 2, wherein said housing has at least one support pole, and said heat exchanger is secured to said support pole of said housing.

9. The heat exchange unit as claimed in claim 2, further including a holding member for holding said second heat exchanger by sandwiching said second heat exchanger therebetween, wherein said housing has at least one support pole, and said holding member is secured to said support pole of said housing.

10. An air conditioning system, comprising:

an indoor heat exchanger having refrigerant circulating therethrough;

an expansion device;

a heat exchanger to which heated fluid is supplied to heat refrigerant; and a power-variable type compressor being adjusted in accordance with an air conditioning load of a room, said adjustments including the power of said power-variable type compressor and the amount of fluid being supplied to said heat exchanger.

11. The heat exchange unit as claimed in claim 1, further comprising refrigerant pipes connecting said indoor units to said outdoor unit.

* * * * *